United States Patent [19]

Dawless et al.

[11] 4,221,590

[45] Sep. 9, 1980

[54] FRACTIONAL CRYSTALLIZATION PROCESS

[75] Inventors: Robert K. Dawless, Monroeville; Robert E. Graziano, Arnold; Arthur A. Bonarett, Creighton, all of Pa.

[73] Assignee: Aluminum Company of America, Pittsburgh, Pa.

[21] Appl. No.: 973,138

[22] Filed: Dec. 26, 1978

[51] Int. Cl.[2] ..... C22B 21/02

[52] U.S. Cl. ..... 75/68 R; 75/63; 75/93 R; 75/10 R

[58] Field of Search ..... 75/68 R, 65 R, 63, 10 R, 75/93 R

[56] References Cited

U.S. PATENT DOCUMENTS

| | | | |
|---|---|---|---|
| 2,471,899 | 5/1949 | Regner | 75/63 |
| 2,659,761 | 11/1953 | Frevel et al. | 260/652 P |
| 3,211,443 | 10/1965 | Starner et al. | 75/68 R UX |
| 3,211,547 | 10/1965 | Jarrett et al. | 75/68 R |
| 3,303,019 | 2/1967 | Jacobs | 75/68 R |
| 3,671,229 | 6/1972 | Ferber et al. | 75/63 |
| 4,043,802 | 8/1977 | Esdaile et al. | 75/63 |
| 4,138,247 | 2/1979 | Esdaile et al. | 75/63 |

*Primary Examiner*—M. J. Andrews
*Attorney, Agent, or Firm*—Andrew Alexander

[57] ABSTRACT

An improved fractional crystallization process for the purification of aluminum is provided which comprises supplying at least a portion of the heat to the fractional crystallization apparatus adjacent the bottom of the apparatus. Impure, molten aluminum is removed from the apparatus by an upper exit port. After initial crystallization of the purified aluminum and removal of at least a portion of the impure molten aluminum, the crystals may be remelted for purposes of recovering purified aluminum.

10 Claims, 2 Drawing Figures

FRACTIONAL CRYSTALLIZATION PROCESS

BACKGROUND OF THE INVENTION

This invention relates to improvements in the purification of aluminum and more particularly to improvement in the fractional crystallization process for the purification of aluminum.

Because of the growing awareness of the limitations of natural resources, particularly energy resources, considerable effort has been expended to produce alternate sources. One such source which is considered to have exceptional potential to fulfill this need is the energy from a fusion nuclear reactor. However, because of the need to isolate or confine the radioactive media involved, considerable investigation is underway to develop materials for the reactor which will not subsequently present disposal problems. For example, if a high purity aluminum were used in the reactor, the radioactivity of such materials would be reduced by a factor which, depending upon the extent of the purity of aluminum, could be as much as a million a few weeks after shutdown. By comparison, if stainless steel were used for the same application, this reduction would take about 1000 years, obviously presenting difficult problems in disposing of such materials.

The use of high purity and extreme purity aluminum is also of growing interest in the stabilization of superconductors. In this application, the electrical energy is transferred at cryogenic temperatures, e.g. 4° K, where the electrical resistance is very low. The higher the purity of the aluminum metal, the lower its resistance, i.e. the higher its conductivity at such low temperatures.

One method used in the prior art for the purification of aluminum is referred to as preferential or fractional crystallization. Such crystallization methods are disclosed by Jarrett et al in U.S. Pat. No. 3,211,547 and by Jacobs in U.S. Pat. No. 3,301,019, incorporated herein by reference. These patents involve the removal of heat from the surface of molten aluminum thereby forming higher purity aluminum crystals in the impure molten aluminum. The pure solid crystals of aluminum are then tamped and packed into the bottom of the crystallization apparatus. The impure molten aluminum is then drained from the apparatus followed by remelting of the pure aluminum which may then be withdrawn in one or several fractions of differing purity depending upon their dilution with impure molten aluminum contained between the crystals prior to remelting.

It is an object of this invention to provide improvements in the purification of aluminum by the fractional crystallization process. This and other objects of the invention will be evident from the specification and drawings.

SUMMARY OF THE INVENTION

In accordance with the invention, improvements are provided in the purification of aluminum by fractional crystallization whereby higher purity aluminum metal solidifies while less purity metal remains in a molten state by removal of heat at the surface of the molten liquid and wherein the solid crystals are packed into the bottom of the apparatus by tamping means and wherein the less pure molten aluminum is withdrawn through an upper exit port to inhibit contamination of the solid, pure aluminum adjacent the bottom of the apparatus. The improvement comprises supplying heat adjacent the bottom of the apparatus during the purification process.

DETAILED DESCRIPTION OF THE PREFERRED EMBODIMENTS

Figure 1:
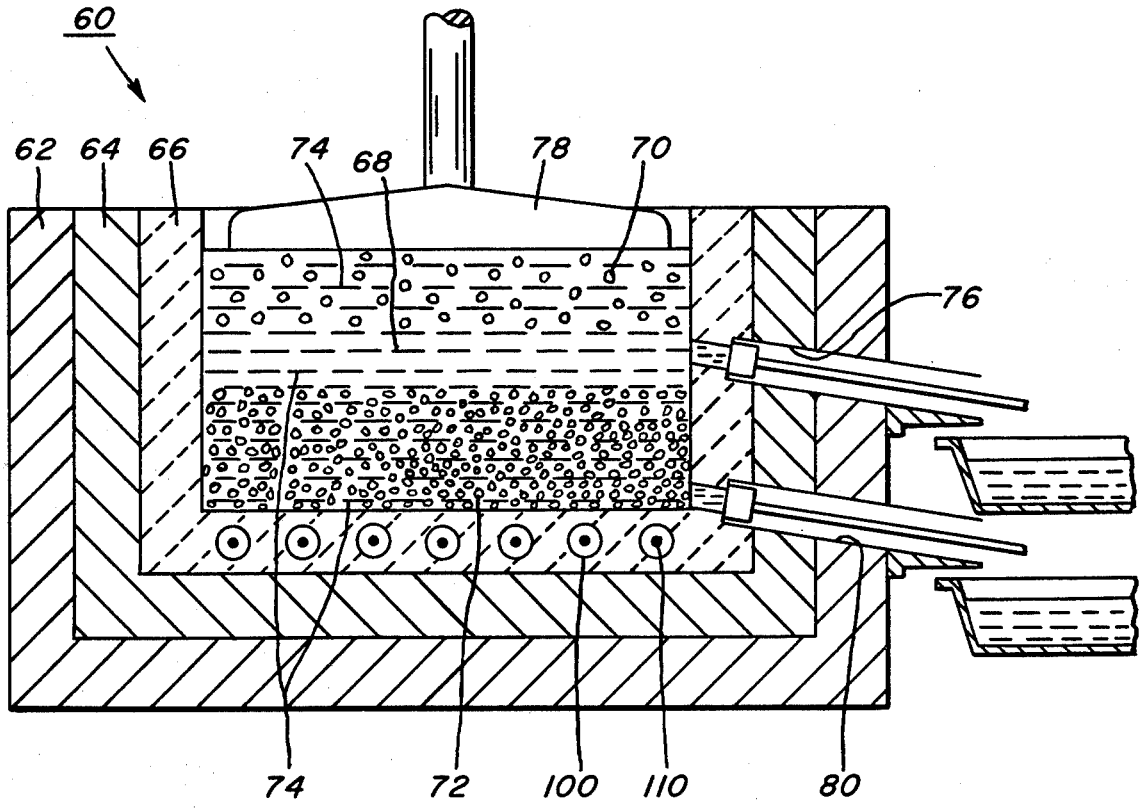
FIG. 1 illustrates schematically a sectional elevation of a fractional crystallization furnace for use in the process of the present invention.

Referring now to FIG. 1, there is shown a container 60 for the improved fractional crystallization process of the invention having an insulating wall 62 which may be heated if desired. The container, preferably, has a layer 64 comprising powdered alumina which provides a barrier to molten aluminum which may escape through inside wall 66. Wall 66 should comprise a material which will not act as a source of contaminant to the molten aluminum 68. Wall 66 is preferably constructed from high purity alumina-based refractories, i.e. at least 90 wt.% and preferably 92 to 99 wt.% alumina. One such refractory may be obtained from Norton Company, Worcester, Massachusetts, under the designation Alundum VA-112. This material is provided in wall 66 in powdered form and then sintered thereby giving it rigidity. This forms a monolithic lining which is less likely to be penetrated by molten aluminum and thus is more suitable for use with the bottom heating system of the invention, as will be described below. For example, material balance checks show a recovery of 99.7 wt.% of the initial charge indicating little or no penetration of the lining.

The use of a high purity alumina lining such as Alundum provides very little contamination. For example, the maximum contamination by iron or silicon is about 2 ppm Fe and 3 ppm Si; and some of this may be attributable to contamination of taphole plugs or the like. Furthermore, sidewall freezing which is also to be avoided, for high purity production, is less of a problem using such a lining than prior art uses of materials such as silicon carbide or the like.

The temperature of the walls of the container is controlled by insulation or by heating so that little or no heat flows outwardly from the molten aluminum body. Heat is withdrawn or removed at the unconfined surface to obtain solidification of the molten aluminum, referred to as the freeze cycle, which brings about fractional crystallization of the pure aluminum in a zone at and immediately under the molten metal unconfined surface. Freezing of the molten metal at the walls of the container should be prevented, if possible, or, if some freezing does occur, it should not constitute more than 10% of the molten body. Molten aluminum which solidifies at the container wall should not be permitted, where practical, to contaminate fractional crystallization occurring in the zone at or beneath the unconfined surface.

In the process of the invention, molten aluminum is introduced into container 60 for purification by fractional crystallization. The aluminum source may be primary aluminum, which typically consists of 99.6 wt.% aluminum, or it may be a higher purity aluminum, such as 99.9 wt.% or 99.993 wt.% aluminum, such as is produced in an electrolytic cell known as a Hoopes cell.

As described in the aforementioned Jarrett et al U.S. Pat. No. 3,211,547, to remove the impurities remaining in the aluminum by fractional crystallization, heat is removed from the molten aluminum at such a rate so as to form and maintain aluminum-rich crystals in zone 70, as shown in FIG. 1. Aluminum-rich crystals thus formed settle by gravity into zone 72 and, after a predetermined amount of fractional crystallization takes place, the remaining impure molten aluminum 74, high in eutectic impurity and which has been displaced towards the upper part of the vessel, can be separated from the aluminum-rich or high purity aluminum by drainage through upper taphole 76. During the freeze process, it is preferred to facilitate the crystal settling process by action of tamper 78 which breaks up massive crystal formations and which also acts to compact the crystals in zone 72, as described in the aforementioned Jarrett et al patent. After removal of the impure molten aluminum mother liquor via taphole 76, the container can be heated to remelt the pure aluminum crystals which are then removed via lower taphole 80.

In accordance with a preferred aspect of the invention, crystals are packed or compacted during the freeze cycle to squeeze out impure liquid from between the crystals located generally in the bottom region 72 of the vessel. Impure liquid having been more or less displaced from area 72 of the unit is removed via upper taphole 76, thus eliminating passing such liquid through the high purity lower region of the crystal bed located generally in bottom 72 of the unit. During the freezing and compacting cycle, it has been discovered that a larger fraction of higher purity aluminum can be obtained by heating the bottom of the unit during the freeze cycle. This heat may be supplied by external induction coils or by resistance wires or globars contained in tubes in the Alundum lining. Silicon carbide type globars, available from the aforementioned Norton Company, may be used. As noted earlier, the use of a monolithic lining which prevents penetration of molten aluminum permits the use of such heating means embedded in the lining. For added protection, each globar 110 may be inserted in a tube of material 100, for example mullite, which is nonconducting and not penetrable by molten aluminum. While the heating means has been shown in the bottom of layer 66 (FIG. 1), it will be understood that additional heating elements may be placed in the sides with beneficial effect.

Heating at or near the bottom of the unit during the freeze cycle, i.e. while heat is being removed at or near the surface, permits remelting of a portion of the crystals located near the bottom of the unit. This melted portion rises or is displaced up through the crystal bed carrying with it impure liquid remaining therein. The rising or displacement of the melted portion up through the crystals is believed to be facilitated by crystals tending to displace the melted portion at or near the bottom of the unit since crystal density is greater than that of the liquid phase or melted portion. Further, bottom heating is very beneficial during the packing or compacting process in that a melted portion can be squeezed up through the crystal bed carrying with it impurities remaining between the crystals or adhering thereto. Bottom heating is also advantageous in that it can prevent freezing of the liquid phase on the bottom entrapping impurities therein which can have an adverse effect on the purity level when all of the crystals are eventually remelted for purposes of removal through lower taphole 80.

It should be understood that normally bottom heating should be carefully controlled during the freeze cycle to prevent excessive remelting. Typically, heating at or adjacent the bottom during the freeze cycle should be controlled so as to introduce heat at a rate of substantially not less than 1 $Kw/ft^2$ of heating area, depending to a certain extent on heat removal at or near the surface for crystallization purposes and depending on insulative values of the walls. A typical heating range at the bottom of the unit is 0.5 to 3.0 $Kw/ft^2$. It will be noted that normally the bottom heating rate is controlled so as to be a fraction of the rate at which the heat is removed. It has been found that typically best results are achieved when the remelt rate at or near the bottom of the unit is controlled so as to be in the range of about 5 to 25% of the crystallization or freeze rate. However, there can be instances when these rates may be higher or lower, depending somewhat on the pressure used in packing and density of the crystal bed.

Figure 2:
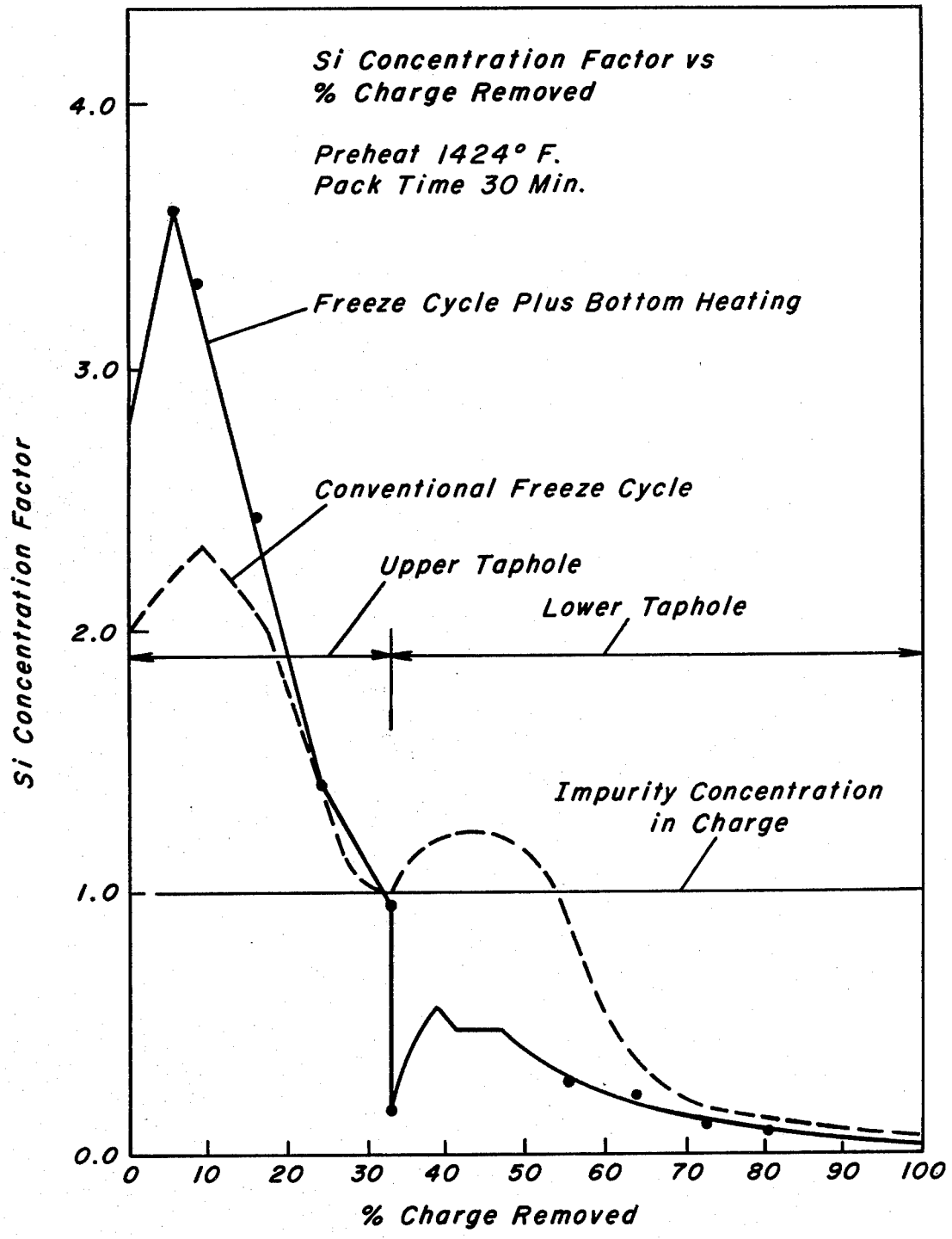
FIG. 2 is a graph showing the concentration factor of silicon in impure aluminum plotted against the percent of charge removed.

The advantages of having controlled heating adjacent the bottom of the vessel for purposes of controlled remelting of crystals are clearly illustrated by reference to FIG. 2 which shows the level of impurity for silicon, for example, which may be achieved with or without bottom heating. That is, FIG. 2 shows the concentration factor (ratio of impurity concentration in a sample to the impurity concentration in the charge) of silicon plotted against the amount of aluminum removed from the crystallization unit. For example, if the initial concentration of silicon in the unit is 360 ppm and its concentration factor (CF) is 1, it will be noted from FIG. 2 that by utilizing bottom heating, the concentration of silicon versus the amount of aluminum removed is high (3.7) compared to the concentration of silicon using a conventional freeze cycle. The high concentration factor is significant in that, first, a greater amount of impurity can be removed through the upper taphole, as can be seen from FIG. 2. Secondly, only a smaller amount of metal has to be removed (about 30% in the instance shown in FIG. 2) to significantly lower the impurity level. That is, from FIG. 2 it will be seen that by the conventional freeze cycle, approximately 60 to 70% of the charge had to be removed for comparable removal of impurity. However, in the present invention as much as 60% of the charge can be recovered as high purity product. It can be seen that by using bottom heating, a significant increase in the yield of purified metal can be achieved. Referring to FIG. 2 as an example, it will be noted that the yield can be doubled. It will be understood that higher concentration factors may be obtained by change of packing pressure and bottom heating. That is, impurities can be further controlled, thereby permitting a smaller fraction to be removed via the upper taphole resulting in even greater yields.

While it is not clearly understood why bottom heating, as well as compacting, provides such advantages with respect to yield, it has been noted that such practice results in purity factors, for example for iron, much higher than would be theoretically explainable by binary phase diagrams. For example, if the starting Fe content is 0.05 wt.%, the binary phase diagram shows that the highest purity material should contain 0.0014 wt.% Fe corresponding to a maximum purification factor of 37. Experiments have been carried out, however, using the above procedure where some material has less than 0.0005 wt.% Fe, even as low as 0.0003 wt.% Fe. This extra purification seems only explainable by replacement of the original liquid by purer liquid through the mechanism of bottom heating and packing. The crystals then equilibrate with the purer liquid according to the theoretical partition functions. That is, it is believed that there is a solid state mass transfer phenomena through and from the solid crystal to a purer liquid phase surrounding the crystal in order to equilibrate with the liquid phase.

The freeze or crystal forming cycle can be carried out over a period of from about 2 to 7 hours. The heating of the bottom of the unit may extend for the same period for purposes of partially remelting some of the crystals near the bottom of bed 72 (FIG. 1). It has been found, though, that bottom heating may be used only for part of the freeze cycle and typically for about the last two-thirds of the freeze cycle.

As well as using bottom heating during the freeze cycle, it has been found that such heating is beneficial also during remelting of the crystals for purposes of their recovery from the fractional crystallization unit. That is, in addition to remelting of the extreme purity product crystals by conventional surface heating, heat is supplied to the bottom of the unit in the same manner as described above. Utilizing bottom heating during the remelting cycle has the advantage that it prevents the liquid phase in the high purity product from freezing at or near the bottom of the vessel which can interfere with purity level. Further, keeping the high purity product in molten form facilitates opening of the lower taphole. Additionally, bottom heating reduces the period required to melt the crystal bed in the unit, greatly increasing the overall economies of the system. Typically, melting of the crystal bed requires about 2 to 5 hours.

The following example is still further illustrative of the invention.

EXAMPLE

About 2000 lbs. of an aluminum alloy containing 360 ppm silicon and other impurities was charged to a crystallization unit substantially as shown in FIG. 1. Only silicon is being followed for purposes of simplifying the example. The charge was first melted after which heat was extracted from the free surface of the melt at about 7 $Kw/ft^2$ for purposes of forming crystals, the heat being removed by blowing air across the surface. After about one hour of operation, bottom heating elements were turned on and heat was introduced across the bottom of the vessel at a rate of about 1.0 $Kw/ft^2$. At about two-second intervals, the tamper blade was pressed down into the unit for purposes of breaking crystal bed formations at or near the surface of the melt. After sufficient crystals were formed, the blade was pressed downwardly (about every two seconds) for purposes of packing the crystals in the lower portion of the unit and for displacing the liquid phase towards the upper part of the unit and carrying with it impurities. The blade pressure ranged from 0 to 20 psi, increasing with the buildup of the crystal bed. It will be noted that bottom heating melts crystals at or near the bottom of the vessel, providing high purity aluminum to purge the crystals as the high purity aluminum is displaced upwardly to the upper region of the vessel. After about three hours of removing heat and about 70% of the charge was crystallized, the upper taphole was opened and the first metal removed was analyzed for silicon concentration. This sample corresponds to zero charge removed in FIG. 2. Thereafter, samples of the charge were taken substantially as shown in FIG. 2. That is, by inspection of FIG. 2, it will be seen that about 33% of the charge was removed through the upper taphole. Further, it will be seen by inspection of the curves that by use of bottom heating during the freeze cycle, silicon was much more concentrated than by use of the conventional method, particularly in the part of the curve which refers to the upper taphole. It will be noted that the greater the amount of impurity which can be concentrated for removal through the upper taphole, the lesser the amount which will be present on removal of the metal through the bottom taphole. Thus, it can be seen that since a greater amount of silicon impurity was removed through the upper taphole, compared to the conventional method, the fraction of metal removed through the lower taphole was much purer than that removed through the lower taphole in the conventional method. From FIG. 1 it will be seen that generally the yield by the present invention is approximately doubled when compared to the conventional method.

Even though only silicon is used for purposes of illustrating the invention, it will be understood that the effect shown in FIG. 2 is the same for any other eutectic impurity that may be encountered. Further, the conventional freeze cycle curve referred to in FIG. 2 was obtained in the same way as explained above except bottom heating was not utilized. In addition, FIG. 2 illustrates that higher yields may be obtained by concentrating the impurities into a smaller volume of metal.

Having thus described the invention, what is claimed is:

1. An improved method for purifying impure aluminum by fractional crystallization, comprising the steps of:

(a) providing a body of impure aluminum in a molten state in a vessel for purposes of purification;

(b) removing heat at the surface of the body of impure aluminum at a controlled rate for purposes for removing eutectic impurities therefrom by forming aluminum crystals therein, said crystals having a higher purity than the remaining liquid aluminum constituting the remaining fraction having impurities concentrated therein, the crystals being displaced away from the heat removing surface;

(c) collecting high purity aluminum crystals in a bed adjacent the bottom of the vessel;

(d) introducing heat at a controlled rate to the body adjacent the bottom thereof for purposes of melting a portion of the crystals collected adjacent the bottom of the vessel whereby the melted portion is moved through the bed of crystals by action of crystal being displaced away from the heat removing surface and whereby the melted portion washes impurities from the surface of the crystals collected in the bottom of the vessel and carries the impurities towards the upper part of the body to concentrate the impurities there and thereby permits liquid aluminum of a higher purity level than the aforesaid remaining fraction to be in contact with the high purity aluminum crystals collected in the bottom of the vessel;

(e) subjecting the high purity aluminum crystals in the bottom of the vessel to a tamping action for purposes of squeezing liquid aluminum and impurities therefrom;

(f) removing liquid aluminum having impurities concentrated therein without removal through the bed of high purity aluminum crystals collected in the bed adjacent the bottom of the vessel; and (g) recovering a body of high purity aluminum crystals in the bottom of the vessel.

2. The method according to claim 1 wherein liquid aluminum having impurities concentrated therein is removed from the vessel by means of an upper exit in said vessel thereby avoiding contamination of said high purity crystals.

3. The method according to claim 2 wherein crystals of aluminum are remelted after removal of the impure fraction, the remelting being facilitated by applying heat adjacent the bottom of the crystal bed.

4. The method according to claim 1 wherein heat is introduced in step (d) thereof at a rate of about 0.5 to 3 $Kw/ft^2$ of heating area.

5. The method according to claim 1 wherein heat is introduced in step (d) thereof at a rate substantially not less than 1 $Kw/ft^2$ of heating area.

6. The method according to claim 1 wherein heat is introduced in step (d) thereof at a rate of about 5 to 25% of the rate at which heat is removed in step (b).

7. An improved method for purifying impure aluminum by fractional crystallization, comprising the steps of:

(a) providing a body of impure aluminum in a molten state in a vessel having upper and lower regions therein for purposes of purification;

(b) removing heat at the surface of the body of impure aluminum at a controlled rate for purposes of removing eutectic impurities therefrom by forming aluminum crystals therein, said crystals having a higher purity than the remaining liquid aluminum constituting the remaining fraction having impurities concentrated therein, the crystals being displaced away from the heat removing surface;

(c) collecting high purity aluminum crystals in a bed adjacent the bottom of the vessel;

(d) introducing heat to the lower region of the vessel at a controlled rate for purposes of melting a portion of the crystals collected therein, the heat being introduced at a rate of about 5 to 25% of the rate heat is removed in step (b) whereby the melted portion washes impurities from the surface of the crystals remaining in the bed and carries impurities with it towards the upper region of the vessel and thereby permits liquid aluminum of a higher purity level than the aforesaid remaining fraction to be in contact with the high purity aluminum crystals collected in the bottom of the vessel;

(e) subjecting the high purity aluminum crystals to a tamping action for purposes of squeezing liquid aluminum and impurities therefrom;

(f) removing liquid aluminum having impurities concentrated therein from the upper region of the vessel by means of an exit in said upper region thereby avoiding contamination of said high purity aluminum collected in the lower region; and (g) recovering a body of high purity aluminum crystals in the bottom of the vessel.

8. The method according to claim 7 wherein the heat is introduced in step (D) at a rate of substantially not less than 1 $Kw/ft^2$.

9. The method according to claim 7 including the step of remelting the crystals of aluminum after removal of the impure fraction, the remelting being facilitated by introducing heat as in step (D).

10. The method according to claim 9 including removing the remelted crystals by means of an exit located in the lower region of the vessel.

* * * * *